US006485681B1

(12) United States Patent
Commandeur et al.

(10) Patent No.: US 6,485,681 B1
(45) Date of Patent: Nov. 26, 2002

(54) PROCESS FOR MANUFACTURING THIN PIPES

(76) Inventors: Bernhard Commandeur, Finkenweg 5, 42489 Wülfrath (DE); Rolf Schattevoy, Breuerweg 20, 42115 Wuppertal (DE); Klaus Hummert, Isselweg 26, 48653 Coesfeld (DE)

( * ) Notice: Subject to any disclaimer, the term of this patent is extended or adjusted under 35 U.S.C. 154(b) by 0 days.

(21) Appl. No.: 09/516,804

(22) Filed: Mar. 1, 2000

Related U.S. Application Data

(62) Division of application No. 09/029,767, filed as application No. PCT/EP96/03780 on Aug. 28, 1996, now Pat. No. 6,136,106.

(30) Foreign Application Priority Data

Sep. 1, 1995 (DE) ..... 195 32 252

(51) Int. Cl.[7] ..... C22C 1/04; C22C 21/04
(52) U.S. Cl. ..... 420/537; 75/249
(58) Field of Search ..... 75/249; 420/537

(56) References Cited

U.S. PATENT DOCUMENTS 4,464,146 A * 8/1984 Zaluzec et al. ..... 228/208
4,537,167 A * 8/1985 Eudier et al. ..... 123/193 C
4,752,535 A * 6/1988 Kvernes ..... 428/547
5,057,274 A * 10/1991 Futamura et al. ..... 420/534
5,080,056 A * 1/1992 Kramer et al. ..... 123/193 CP
5,434,210 A * 7/1995 Rangaswamy et al. ..... 524/406
5,756,150 A * 5/1998 Mori et al. ..... 427/197
6,030,577 A * 2/2000 Commandeur et al. ..... 419/28
6,086,819 A * 7/2000 Commandeur et al. ..... 419/5
6,096,143 A * 8/2000 Ruckert et al. ..... 148/439
6,200,642 B1 * 3/2001 Kanai et al. ..... 427/456
6,221,504 B1 * 4/2001 Pfeffinger et al. ..... 428/564
6,329,021 B1 * 12/2001 Haug et al. ..... 427/449

* cited by examiner

*Primary Examiner*—Daniel J. Jenkins

(57) ABSTRACT

The invention relates to a method for manufacturing thin-walled pipes, which are made of a heat-resistant and wear-resistant aluminum-based material. The method comprises the spray-compacting of a thick-walled pipe made of a hypereutectic aluminum-silicon AlSi material, possibly a subsequent overaging annealing, and the hot deformation to a thin-walled pipe. Such a method is in particular suited for the production of cylinder liners of internal combustion engines, since the produced liners exhibit the required properties in regard to wear resistance, heat resistance and reduction of pollutant emission.

11 Claims, No Drawings

PROCESS FOR MANUFACTURING THIN PIPES

REFERENCE TO RELATED APPLICATIONS

The present application is a divisional application of another application, Ser. No. 09/029,767 filed on Aug. 28, 1996 now U.S. Pat. No. 6,136,106, which is a 371 of PCT/EP96/03780, filed Aug. 28, 1996.

The invention relates to a method for manufacturing thin-walled pipes, which pipes are made of a heat-resistant and wear-resistant aluminum-based material, in particular for use as cylinder liners for internal combustion engines.

Cylinder liners are components subject to wear, which are inserted, pressed or cast into the cylinder openings of the crankcase of the internal combustion engine.

The cylinder faces of an internal combustion engine are subjected to high frictional loads from the pistons or, respectively, from the piston rings and to locally occurring high temperatures. It is therefore necessary that these faces be made of wear-resistant and heat-resistant materials.

In order to achieve this goal, there are numerous processes amongst others to provide the face of the cylinder bore with wear-resistant coatings. Another possibility is to dispose a cylinder liner made of a wear-resistant material in the cylinder. Thus, gray-cast-iron cylinder liners were used, amongst others, which liners however exhibit a low heat conductivity as compared to aluminum-based materials and exhibit other disadvantages.

The problem was first solved with a cast cylinder block made of a hypereutectic aluminum-silicon AlSi alloy. The silicon content is limited to a maximum of 20 weight-percent for reasons associated with casting technology. As a further disadvantage of the casting method it is to be mentioned that primary silicon particles of relatively large dimensions (about 30–80 $\mu$m.) are precipitated during the solidification of the melt. Based on the size and their angular and sharp-edged form, the primary silicon Si particles lead to wear at the piston and piston rings. One is therefore forced to protect the pistons and the piston rings with corresponding protective layers/coatings. The contact face of the silicon Si particles to the piston/piston ring is flat-smoothed through mechanical machining treatment. An electrochemical treatment then follows to such a mechanical treatment, whereby the aluminum matrix is slightly reset between the silicon Si grains such that the silicon Si grains protrude insignificantly as support structure from the cylinder face. The disadvantage of thus manufactured cylinder barrels lies, on the one hand, in a substantial manufacturing expenditure (costly alloy, expensive mechanical machining treatment, iron-coated pistons, armored and reinforced piston rings) and, on the other hand, in the defective distribution of the primary silicon Si particles. Thus, there are large areas in the microstructure which are free of silicon Si particles and thus are subject to an increased wear. In order to prevent this wear, a relatively thick oil film is required as separation medium between barrel and friction partner. The clearing depth of the silicon Si particles is amongst others decisive for the setting of the oil-film thickness. A relatively thick oil film leads to higher friction losses in the machine and to a larger increase of the pollutant emission.

In comparison, a cylinder block according to the DE 42 30 228, which is cast of an below-eutectic aluminum-silicon AlSi alloy and is provided with liners of a hypereutectic aluminum-silicon AlSi alloy material is more cost advantageous. However, the aforementioned problems are also not solved in this case.

In order to employ the advantages of the hypereutectic aluminum-silicon AlSi alloys as a liner material, the microstructure in regard to the silicon grains is to be changed. As is known, aluminum alloys, which cannot be realized using casting technology, can be custom-produced by powder-metallurgic processes or spray compacting.

Thus, in this way hypereutectic aluminum silicon AlSi alloys are produceable which have a very good wear resistance and receive the required heat resistance through alloying elements such, as for example iron Fe, nickel Ni, or manganese Mn, based on the high silicon content, the fineness of the silicon particles, and the homogeneous distribution. The primary silicon particles present in these alloys have a size of about 0.5 to 20 $\mu$m. Therefore, the alloys produced in this way are suited for a liner material.

Even though aluminum alloys are in general easy to be processed, the deformation of these hypereutectic alloys is more problematic. A method for producing liners from a hypereutectic aluminum-silicon alloy is known from the German printed patent document EP 0 635 318. According to this reference, the liner is produced by extrusion presses at very high pressures and extrusion rates of 0.5 to 12 m/min. Very high extrusion rates are required in order to produce cost-effectively the liners to a final dimension with extruders. It has been shown that the high extrusion rates lead to a tearing of the profile during extrusion in case of such difficultly extrudable alloys and of the small wall thicknesses of the liners to be achieved.

The spray-compacting of hollow cylinders, the so-called tube blanks, is known from the WO 87/03012. For example, the manufacture of tube blanks having wall thicknesses of 25 to 40 mm is described. The same above-described problems occur upon deformation of such tube blanks to thin-walled pipes, for example, by extrusion.

The object of the invention is therefore to provide for an improved and much more cost-advantageous method for manufacturing thin-walled pipes, in particular for cylinder liners of internal combustion engines, wherein the finished liners are to exhibit the required property improvements in regard to wear resistance, heat resistance, and reduction of the pollutant emission.

SUMMARY

The invention relates to a method for manufacturing thin-walled pipes, which are made of a heat-resistant and wear-resistant aluminum-based material.

The method comprises the spray-compacting of a thick-walled pipe made of a hypereutectic aluminum-silicon AlSi material, possibly a subsequent overaging annealing, and the hot deformation to a thin-walled pipe.

Such a method is in particular suited for the production of cylinder liners of internal combustion engines, since the produced liners exhibit the required properties in regard to wear resistance, heat resistance and reduction of pollutant emission.

Additional embodiments of the invention are given in the sub-claims.

The required tribological properties are in particular achieved in that silicon particles are present in the material as primary precipitates in a size range of from 0.5 to 20 $\mu$m, or as added and admixed particles in a size range of up to 80 $\mu$m. Methods have to be employed for the manufacture of such aluminum Al alloys which allow a substantially higher solidification rate of a high-alloy melt than it is possible with conventional casting processes.

On the one hand, the spray compacting method (in the following referred to as "spray compacting") belongs to this. An aluminum alloy melt, highly alloyed with silicon, is atomized and cooled in the nitrogen stream at a cooling rate of 1000° C./s. The in part still liquid powder particles are sprayed onto a support pipe, rotating horizontally around the longitudinal axis and made of the same type of material or a conventional aluminum material (for example, $AlMgSi_{0.5}$). The support pipe, which has preferably wall thicknesses of from 2 to 3 mm, is linearly shifted under the spray beam during the process. By superpositioning the rotation motion and the translation motion of the support pipe, there is generated a cylindrical pipe having a fixed predetermined inner diameter. The outer diameter results from the charging speed and from the effective compacting rate. Pipes having wall thicknesses of from 6 to 20 mm can be manufactured in this way. A quasi continuous production operation can be achieved with suitable feed and guiding systems for the support pipes.

Primary silicon Si precipitates having a size of up to 20 μm are generated in this spray-compacting process based on the high cooling speeds. An adaptation of the silicon Si precipitate size is achieved with the "gas to metal ratio" (standard cubic meter of gas per kilogram of melt), with which the solidification speed can be set in the process. Silicon Si contents of the alloys of up to 40 weight-% can be realized based on the high solidification speeds and the supersaturation of the melt. The supersaturation state in the resulting billet is quasi "frozen" based on the fast quenching of the aluminum melt in the gas stream.

The spray compacting process in addition offers the possibility to enter particles with a particle injector into the billets or into the tube blanks, which particles were not present in the melt. There exists a plurality of adjustment possibilities for a microstructure since these particles can exhibit any desired geometry and any desired size between 2 μm and 400 μm. These particles can be, for example, silicon Si particles in the range of from 2 μm to 400 μm or oxide-ceramic particles (for example, $Al_2O_3$) or non-oxide-ceramic particles (for example, SiC, $B_4C$, etc.) in the aforementioned particle-size spectrum, as they are commercially available and sensible for the tribological aspect.

The microstructural condition of the spray-compacted pipe can be changed with subsequent averaging annealing processes. The microstructure can be set with an annealing to a silicon grain size of from 2 to 30 μm as it is desired for the required tribological properties. The growing of larger silicon Si particles during the annealing process is effected by diffusion in the solid at the expense of smaller silicon particles. This diffusion is dependent on the overaging and annealing temperature and the duration of the annealing treatment. The higher the temperature is chosen, the faster the silicon Si grains grow. Suitable temperatures are at about 500° C., wherein an annealing duration of 3 to 5 hours is sufficient.

The thereby resulting and therefore custom-made microstructure no longer changes in the subsequent processing steps or it changes in the sense of the required tribological properties.

A reduction of the wall thickness to the required final dimensions is achieved by hot deformation by means of various processes dependent on the starting wall thickness of the such manufactured pipes. The process temperatures are between 300° C. and 550° C. In this case, the hot deformation serves not only for the forming, but also to the closing of the process-caused residual porosity (1–5%) in the spray-compacted starting material.

The pipe, formed to the final wall thickness, is subsequently cut into pipe sections of the required length.

The invention method has the advantage that the material for the liner can be custom-made. At the same time, the high expenditure in the case of one-step extruding of thin-walled pipes, both in regard to extrusion pressure and extrusion rate, as well as product quality and production economy, is successfully avoided based on the described method of production.

EXAMPLE 1

An alloy of the composition $AlSi_{25}Cu_{2.5}Mg_1Ni_1$ is compacted to a pipe having a wall thickness of 15.0 mm at a melt temperature of 830° C. with a gas/metal ratio of 4.5 $m^3$/kg (standard cubic meter gas per kilogram of melt) by spray-compacting on a support pipe (inner diameter: 69.5 mm, wall thickness: 2.0 mm) at a charging speed of about 0.6 m/min. The silicon Si precipitates in the size range of from 1 μm to 10 μm are present under the recited conditions in the spray-compacted material. The spray-compacted pipe is subjected to an annealing treatment of four hours at 520° C. The silicon Si precipitates are in the size range of from 2 μm to 30 μm after this annealing treatment. The spray-compacted pipe is formed by subsequent hot deformation by swaging at 420° C. from an outer diameter of 98 mm to an outer diameter of 79 mm and an inner diameter of 69 mm, wherein the inner diameter is formed by a mandrel. The degree of deformation is sufficient to completely close the aforementioned residual porosity in the spray-compacted pipe. No other change in microstructure occurs during swaging.

What is claimed is:

1. An aluminum-silicon alloy with a hypereutectic amount of silicon in the aluminum alloy for manufacturing liners for internal combustion engines produced by the following steps:

spray compacting an aluminum alloy with a hypereutectic amount of silicon in the aluminum alloy melt onto a rotating support pipe such that there is generated directly a thick-walled pipe of a wall thickness of from 6 to 20 mm of the aluminum alloy material with the hypereutectic amount of silicon in the aluminum alloy material, wherein contained primary silicon particles have a size of from about 0.5 to 20 μm;

reducing said thick-walled pipe by a hot-deformation process at temperatures of from 250 to 500° C. to a wall thickness of 1.5 to 5 mm.

2. The aluminum-silicon alloy according to claim 1, wherein the contained primary silicon particles have a size of from 1 to 10 μm.

3. The aluminum-silicon alloy according to claim 1, further comprising the production step of:

annealing said thick-walled pipe for coarsening the contained primary silicon particles to overage them for growing the primary silicon particles to a size of from about 2 to 30 μm.

4. The aluminum-silicon alloy according to claim 1, wherein the alloy is of the following composition:

from about 17 to 35 weight percent silicon, from about 2.5 to 3.5 weight percent copper, from about 0.2 to 2 weight percent magnesium, from about 0.5 to 2 weight percent nickel, and wherein the balance of the alloy is aluminum.

5. The aluminum-silicon alloy according to claim 1, wherein the alloy is of the following composition:

from about 17 to 35 weight percent silicon, from about 3.0 to 5.0 weight percent iron, from about 1.0 to 2.0 weight percent nickel, and wherein the remaining balance of the alloy is aluminum.

6. The aluminum-silicon alloy according to claim 1, wherein the alloy is of the following composition:

from about 25 to 35 weight percent silicon, and wherein the balance of the alloy is aluminum.

7. The aluminum-silicon alloy according to claim 1, wherein the alloy is of the following composition:

from about 17 to 35 weight percent silicon, from about 2.5 to 3.3 weight percent copper, from about 0.2 to 2 weight percent magnesium, from about 0.5 to 5 weight percent manganese, and wherein the balance of the alloy is aluminum.

8. The aluminum-silicon alloy according to claim 1, further comprising the production step of:

melting an aluminum alloy with from about 5 to 15 weight percent of silicon for obtaining an alloy melt;

spray compacting the alloy melt; and furnishing an additional part of the silicon in the form of silicon powder by means of a particle injector into the pipe during spray compacting to obtain a pipe made of an aluminum alloy with a hypereutectic amount of silicon in the aluminum alloy.

9. The aluminum-silicon alloy according to claim 1, further comprising the production step of:

furnishing in addition wear-resistant particles with a particle injector during spray-compacting.

10. The aluminum-silicon alloy according to claim 1, further comprising the production step of:

performing the hot-deformation process of the thick-walled pipe by a process selected from the processes consisting of round kneading, swaging, rotary swaging, tube rolling with an internal tool, press rolling, tube drawing, annular rolling, hollow—forward—extrusion molding, hollow—backward—extrusion molding, and combinations thereof.

11. A liner for internal combustion engines made of a hypereutectic aluminum silicon AlSi alloy by the production steps of:

depositiong an aluminum silicon AlSi alloy melt by spray compacting onto a rotating support pipe such that there is generated directly a thick-walled pipe of a wall thickness of from 6 to 20 mm of a hypereutectic aluminum silicon AlSi material, wherein the contained primary silicon Si particles have a size of from 0.5 to 20 $\mu$m, subjecting said thick-walled pipe to an overaging annealing, wherein the primary silicon Si particles grow to a size of 2 to 30 $\mu$m;

reducing said pipe is reduced by a hot deformation process at temperatures of from 250 to 500° C. to a wall thickness of 1.5 to 5 mm.

* * * * *

UNITED STATES PATENT AND TRADEMARK OFFICE

CERTIFICATE OF CORRECTION

PATENT NO. : 6,485,681 B1 
DATED : November 26, 2002
INVENTOR(S) : Bernhard Commandeur, Rolf Schattevoy and Klaus Hummert It is certified that error appears in the above-identified patent and that said Letters Patent is hereby corrected as shown below:

Title page,
Item [73], Assignee, the following information is missing on the title page:

-- [73] Assignee: Erbsloh Aktiengesellschaft
Verlbert, Germany --

Signed and Sealed this

Fifth Day of April, 2005

JON W. DUDAS
*Director of the United States Patent and Trademark Office*